US006672377B2

(12) United States Patent
Liu

(10) Patent No.: US 6,672,377 B2
(45) Date of Patent: Jan. 6, 2004

(54) OIL COOLER

(76) Inventor: Jui Lung Liu, No. 48, Lane 28, Hushan St., Sanhu Li, Yangmei Jen, Taoyuan (TW)

( * ) Notice: Subject to any disclaimer, the term of this patent is extended or adjusted under 35 U.S.C. 154(b) by 205 days.

(21) Appl. No.: 10/035,115

(22) Filed: Jan. 4, 2002

(65) Prior Publication Data

US 2003/0205366 A1 Nov. 6, 2003

(51) Int. Cl.[7] ..... F28D 7/10

(52) U.S. Cl. ..... 165/154; 165/916; 165/907; 285/334.5

(58) Field of Search ..... 165/154, 155, 165/41, 916, 907; 285/331, 332, 334.5

(56) References Cited

U.S. PATENT DOCUMENTS 3,339,260 A * 9/1967 Burne et al. ..... 29/890.036
4,029,345 A * 6/1977 Romanelli ..... 285/334.2
4,475,584 A * 10/1984 Martin et al. ..... 165/76
4,610,466 A * 9/1986 Geer et al. ..... 285/12
5,950,716 A * 9/1999 Appelquist et al. ..... 165/109.1

* cited by examiner

*Primary Examiner*—Allen Flanigan
(74) *Attorney, Agent, or Firm*—Rosenberg, Klein & Lee

(57) ABSTRACT

An oil cooler comprises an inner water pipe, an outer oil pipe, a strainer pipe sleeved between oil pipe and water pipe, and a connector mechanism at either end of oil cooler and including a hollow cylindrical connector having a passage coupled to water pipe, a ring groove, a plurality of first O-ring grooves, an abutment groove adjacent ring groove, and an oil channel connected to strainer pipe, a ring fitted in ring groove, and a plurality of first O-rings fitted in O-ring grooves. The invention adopts a snapping mechanism to secure oil pipe to the cylindrical connector, thus eliminating potential crack in welded portion of pipes and end connectors and leakage. Moreover, it is easy to assemble, durable, and high in cooling efficiency.

4 Claims, 5 Drawing Sheets

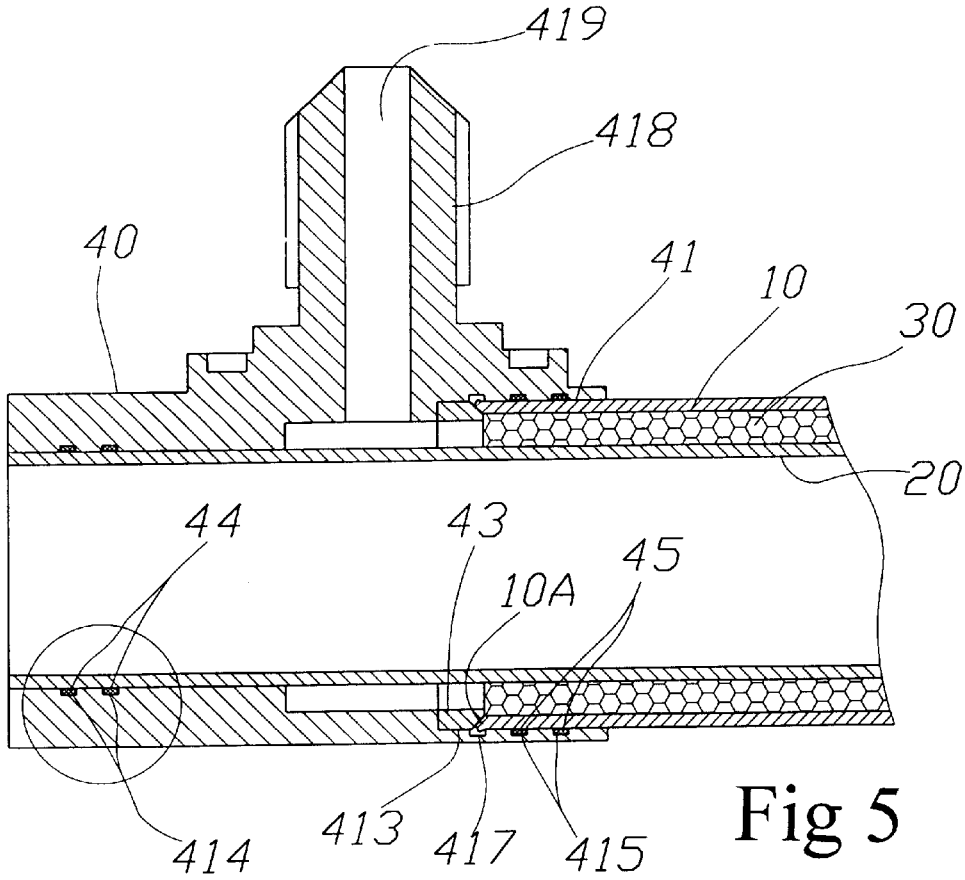
Fig 5
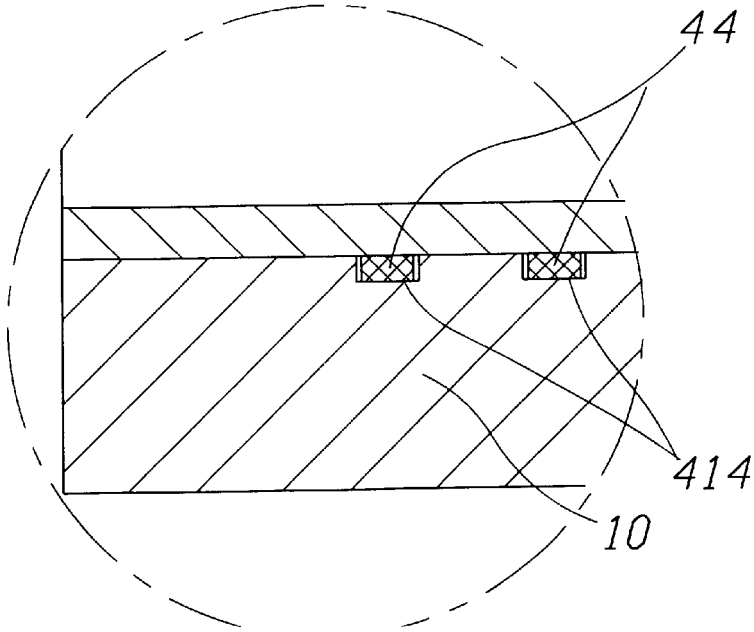

OIL COOLER

FIELD OF THE INVENTION

The present invention relates to oil cooler and more particularly to an easy assembled oil cooler capable of preventing crack caused by irregular heat expansion from occurring.

BACKGROUND OF THE INVENTION

It is known that high heat may be generated in a machine during operating.

This is particularly true in an enclosed environment. Hence, heat dissipation is very important. Otherwise, machine is subject to malfunction. A conventional oil cooler 90 in a gearshift box is shown in FIG. 1. The cooler 90 comprises a cooling pipe 91 including an inner water pipe and a spaced outer oil pipe, and two end connectors 92 each coupled to cooling pipe 91 at A by welding, end connectors 92 having an oil inlet 93, an oil outlet 95 both in fluid communication with oil pipe, a water inlet 94, and a water outlet 96 both in fluid communication with water pipe. With this construction, hot oil can be cooled cyclically. Note that cooling pipe 91 are welded to rather than integrally formed with end connectors 92 because oil-water separation and leak-proof arrangements are provided within cooling pipe 91. However, welding can cause a problem of uneven stress distribution. Further, the welded areas A tend to crack caused by irregular heat expansion since cooling pipe 91 and end connectors 92 are typically under high temperature operating environment. A broken oil cooler 90 can neutralize the oil-water separation capability thereof or cause leakage. As a result, a heat dissipation capability of the oil cooler 90 is lowered. Further, solder paste used in welding may generate poison gas which may pollute the environment and cause health problem to workers. Thus, it is desirable to provide a leak-proof while environmental friendly oil cooler in order to overcome the above drawbacks of prior art.

SUMMARY OF THE INVENTION

It is therefore an object of the present invention to provide an oil cooler which can eliminate potential crack in welded portion of cooling pipe and end connectors and leakage as experienced in prior art. By utilizing this, it is possible of maintaining a normal operation and increasing a useful life of the oil cooler.

It is another object of the present invention to provide an oil cooler wherein cooling pipe and end connectors are easy to assemble. Most importantly, an effective oil-water separation is carried out by the oil cooler.

The above and other objects, features and advantages of the present invention will become apparent from the following detailed description taken with the accompanying drawings.

BRIEF DESCRIPTION OF THE DRAWINGS

FIG. 5 shows details of left-hand portion of the FIG. 3 oil cooler.

DETAILED DESCRIPTION OF THE PREFERRED EMBODIMENTS

Figure 1:
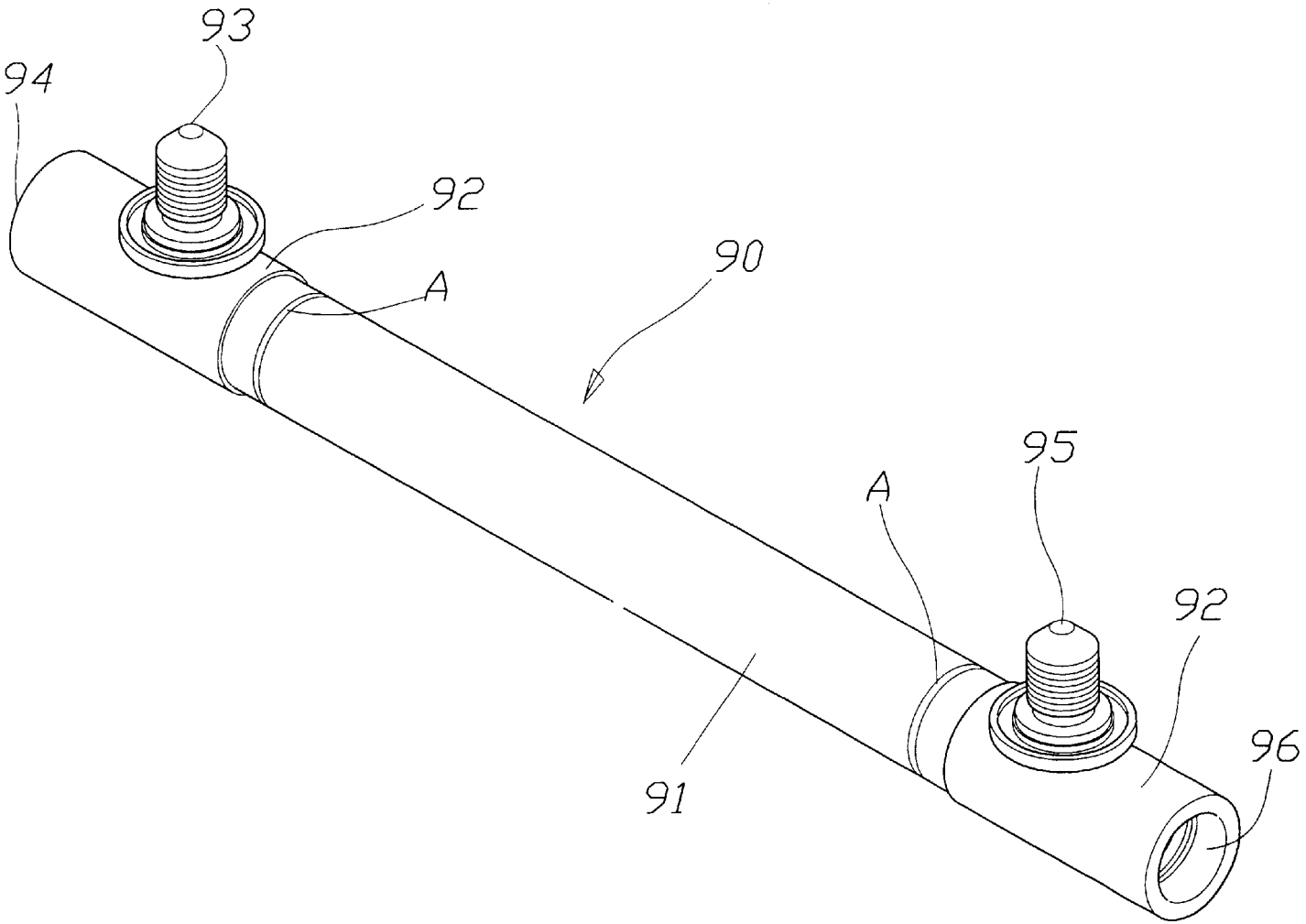
FIG. 1 is a perspective view of a conventional oil cooler.
Figure 2:
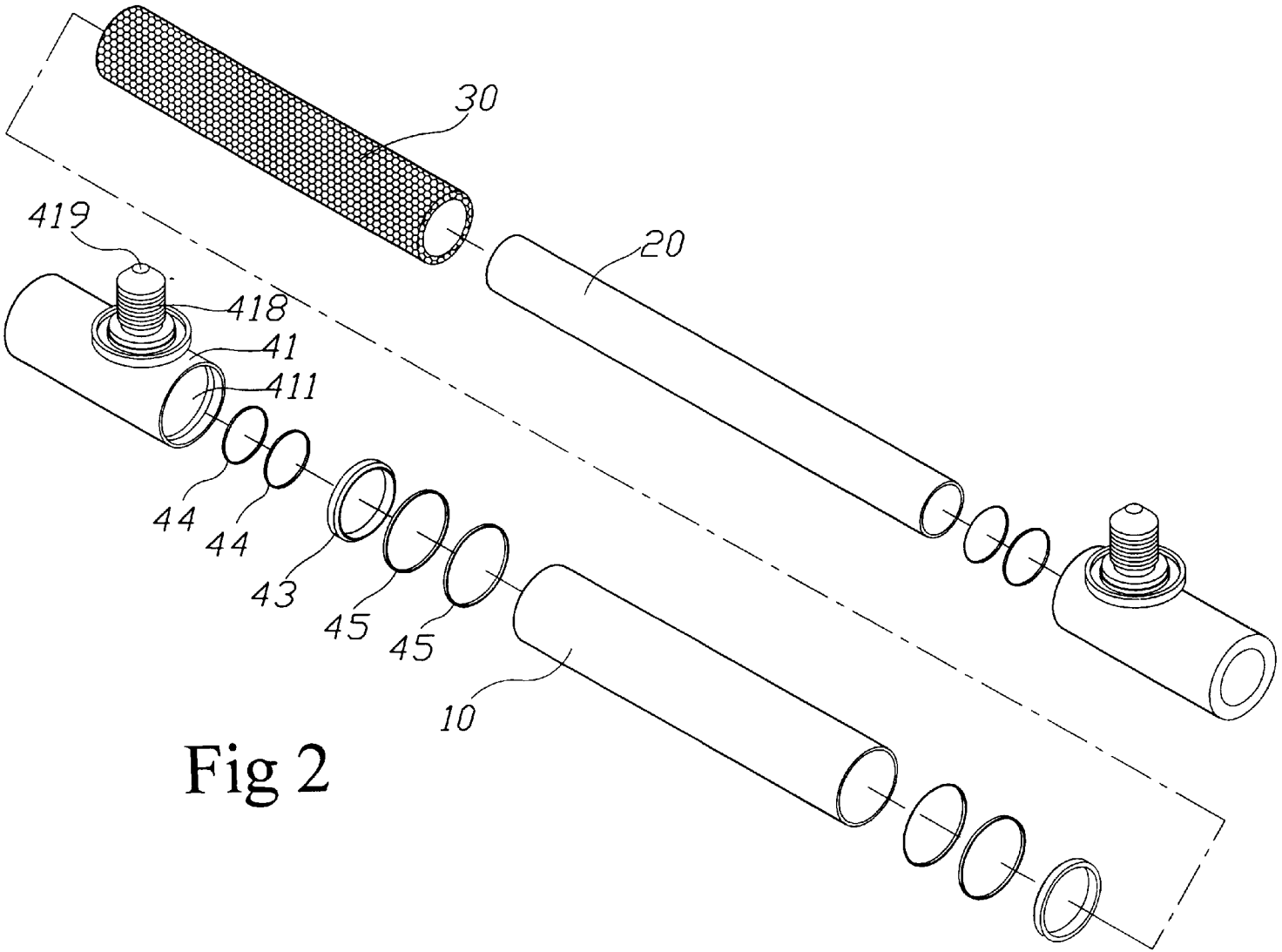
FIG. 2 is an exploded view of a preferred embodiment of oil cooler according to the invention.
Figure 3:
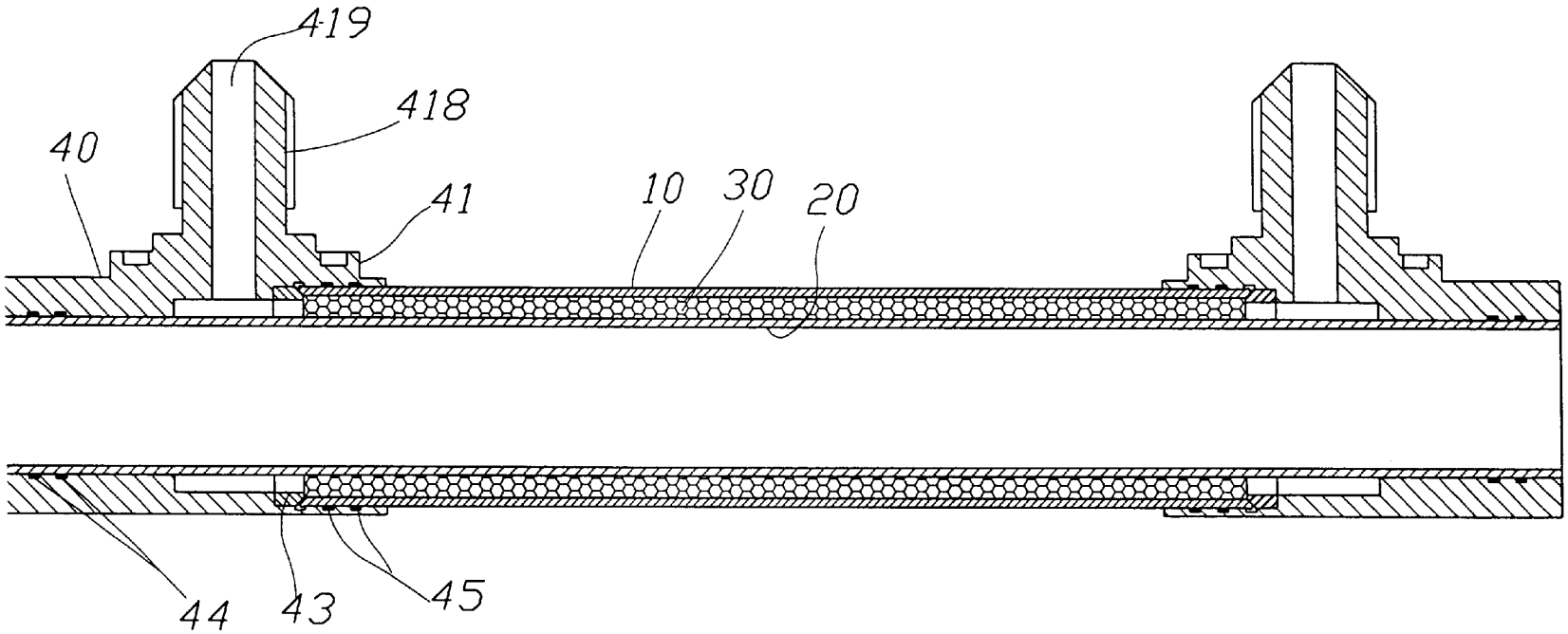
FIG. 3 is a cross-sectional view of the oil cooler.
Figure 4:
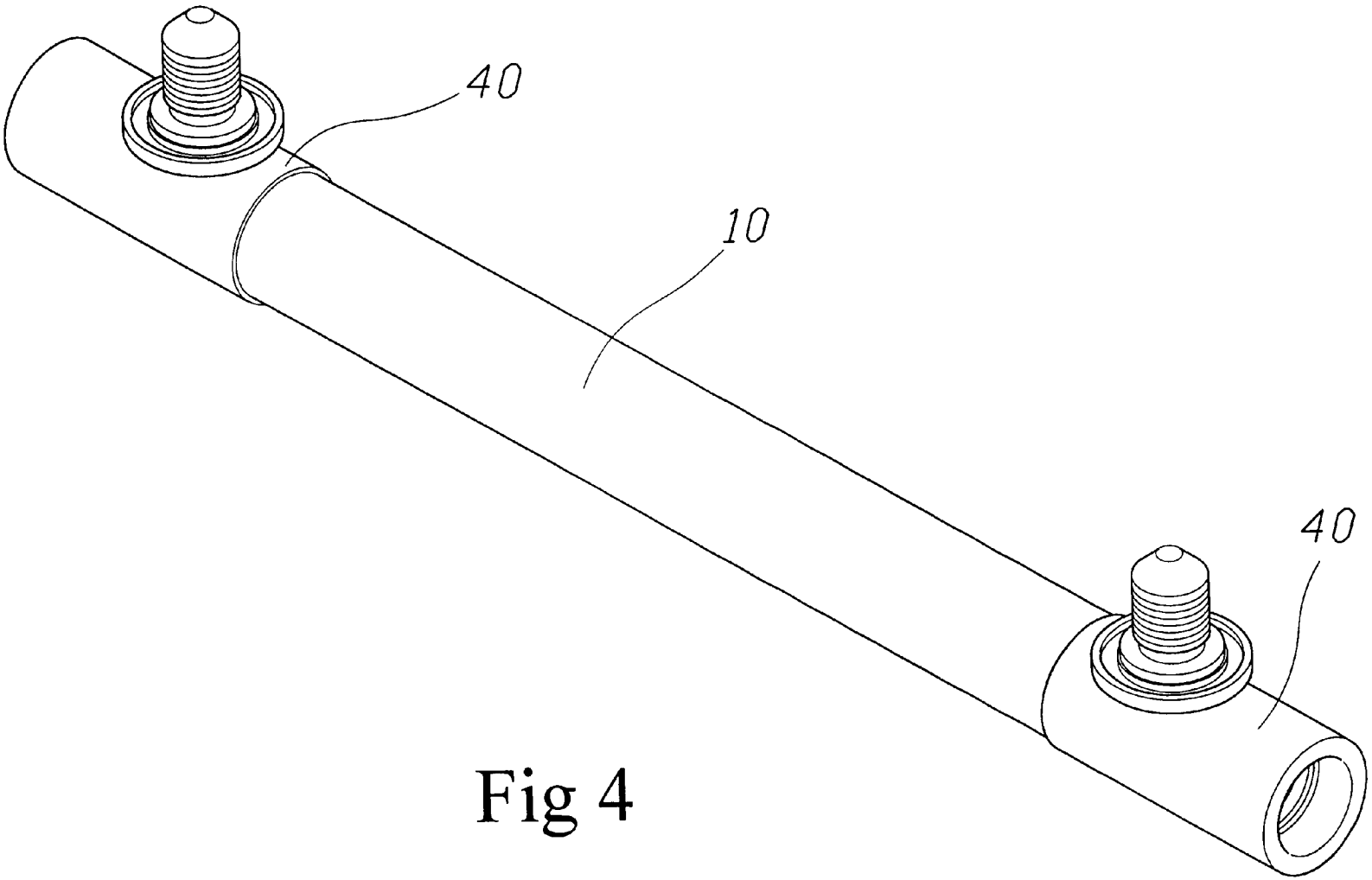
FIG. 4 is a perspective view of the oil cooler.

Referring to FIGS. 2 to 5, there is shown an oil cooler constructed in accordance with the invention comprising an inner water pipe 20, an outer oil pipe 10 having a length shorter than that of water pipe 20, a strainer pipe 30 sleeved between oil pipe 10 and water pipe 20 for disturbing oil flow so as to increase a heat exchange effect, and a connector mechanism 40 at either end of the oil cooler and including a hollow cylindrical connector 41 having a passage 411 coupled to water pipe 20 for allowing water to flow through, a ring groove 413, two smaller O-ring grooves 414, two larger O-ring grooves 415, and an abutment groove 417 adjacent and between ring groove 413 and larger O-ring grooves 415, a copper ring 43 fitted in ring groove 413, two smaller O-rings 44 fitted in smaller O-ring grooves 414, and two larger O-rings 45 fitted in larger O-ring grooves 415. The hollow cylindrical connector 41 further comprises an oil connector 418 thereon and an oil channel 419 through the oil connector 418 connected to the strainer pipe 30.

In assembly, put strainer pipe 30 on water pipe 20 and put oil pipe 10 on strainer pipe 30. Fit connectors 41 in both ends of oil pipe 10 wherein ends 10A of oil pipe 10 urge against copper rings 43. Also, ends 10A are deformed by force exerted thereon so as to snappingly secure to abutment groove 417. As hot oil flows from oil channel 419 into passage 411, oil is prevented from leaking because the provision of larger O-rings 45 between oil pipe 10 and the hollow cylindrical connector 41 and smaller O-rings 44 between water pipe 20 and the hollow cylindrical connector 41. In brief, the invention adopts a snapping mechanism to secure oil pipe 10 to the hollow cylindrical connector 41. Thus, drawbacks, e.g., potential crack in welded portion of cooling pipe and end connectors and leakage, as experienced in prior art are totally eliminated. Moreover, it is easy to assemble, durable, and high in cooling efficiency.

While the invention has been described by means of specific embodiments, numerous modifications and variations could be made thereto by those skilled in the art without departing from the scope and spirit of the invention set forth in the claims.

What is claimed is:

1. An oil cooler comprising an inner water pipe, an outer oil pipe, a strainer pipe sleeved between the oil pipe and the water pipe, and a connector mechanism at either end of the oil cooler and including a hollow cylindrical connector having a passage coupled to the water pipe, a ring groove, a plurality of first O-ring grooves, an abutment groove adjacent the ring groove, and an oil channel connected to the strainer pipe, a ring fitted in the ring groove, and a plurality of first O-rings fitted in the O-ring grooves.

2. The oil cooler of claim 1, wherein a length of the water pipe is longer than that of the oil pipe.

3. The oil cooler of claim 1, further comprising a plurality of second O-ring grooves and a plurality of second O-rings fitted in the second O-ring grooves between the hollow cylindrical connector and the water pipe.

4. The oil cooler of claim 1, wherein ends of the oil pipe urge against the rings so that the ends of the oil pipe are capable of being deformed by a force exerted thereon so as to snappingly secure to the abutment groove.

* * * * *